US008511975B2

(12) United States Patent
Shi et al.

(10) Patent No.: US 8,511,975 B2
(45) Date of Patent: Aug. 20, 2013

(54) GAS TURBINE SHROUD ARRANGEMENT

(75) Inventors: Jun Shi, Glastonbury, CT (US); Kevin E. Green, Broad Brook, CT (US); Paul F. Croteau, Columbia, CT (US)

(73) Assignee: United Technologies Corporation, Hartford, CT (US)

( * ) Notice: Subject to any disclaimer, the term of this patent is extended or adjusted under 35 U.S.C. 154(b) by 114 days.

(21) Appl. No.: 13/176,080

(22) Filed: Jul. 5, 2011

(65) Prior Publication Data

US 2013/0008176 A1 Jan. 10, 2013

(51) Int. Cl.
*F04D 29/08* (2006.01)

(52) U.S. Cl.
USPC ..... 415/173.1; 415/213.1

(58) Field of Classification Search
USPC ..... 415/134, 173.1, 213.1
See application file for complete search history.

(56) References Cited

U.S. PATENT DOCUMENTS

| | | | |
|---|---|---|---|
| 4,008,978 | A | 2/1977 | Smale |
| 4,363,208 | A | 12/1982 | Hoffman et al. |
| 4,398,866 | A | 8/1983 | Hartel et al. |
| 4,573,320 | A | 3/1986 | Kralick |
| 4,759,687 | A | 7/1988 | Miraucourt et al. |
| 5,392,596 | A | 2/1995 | Holsapple et al. |
| 5,466,122 | A | 11/1995 | Charbonnel et al. |
| 6,042,315 | A | 3/2000 | Miller et al. |
| 6,045,310 | A | 4/2000 | Miller et al. |
| 6,250,883 | B1 | 6/2001 | Robinson et al. |
| 6,451,416 | B1 | 9/2002 | Holowczak et al. |
| 6,514,046 | B1 | 2/2003 | Morrison et al. |
| 6,648,597 | B1 | 11/2003 | Widrig et al. |
| 6,696,144 | B2 | 2/2004 | Holowczak et al. |
| 6,709,230 | B2 | 3/2004 | Morrison et al. |
| 7,153,096 | B2 | 12/2006 | Thompson et al. |
| 7,198,458 | B2 | 4/2007 | Thompson |
| 7,247,003 | B2 | 7/2007 | Burke et al. |
| 7,435,058 | B2 | 10/2008 | Campbell et al. |
| 7,452,182 | B2 | 11/2008 | Vance et al. |
| 7,452,189 | B2 | 11/2008 | Shi et al. |
| 7,488,157 | B2 | 2/2009 | Marini et al. |
| 7,600,970 | B2 | 10/2009 | Bhate et al. |
| 7,648,336 | B2 | 1/2010 | Cairo |
| 7,665,960 | B2 | 2/2010 | Shi et al. |
| 7,771,160 | B2 | 8/2010 | Shi et al. |
| 2005/0254942 | A1 | 11/2005 | Morrison et al. |
| 2010/0021290 | A1 | 1/2010 | Schaff et al. |
| 2011/0027098 | A1 | 2/2011 | Noe et al. |
| 2011/0052384 | A1* | 3/2011 | Shi et al. ..... 415/200 |

OTHER PUBLICATIONS

Characterization of First-Stage Silicon Nitride Components After Exposure to an Industrial Gas Turbine H.-T. Lin et al., J. Am. Ceram. Soc. Journal, 89 [1] pp. 258-265 (2006).

(Continued)

*Primary Examiner* — Dwayne J White
(74) *Attorney, Agent, or Firm* — Bachman & LaPointe, P.C.

(57) ABSTRACT

A system for supporting a shroud used in an engine has a shroud positioned radially outboard of a rotor, which shroud has a plurality of circumferentially spaced slots; a forward support ring for supporting the shroud; the forward support ring having a plurality of spaced apart first tabs on a first side for functioning as anti-rotation devices; the forward support ring having a plurality of spaced apart second tabs on a second side; and the second tabs engaging the slots in the shroud and circumferentially supporting the shroud.

25 Claims, 10 Drawing Sheets

(56) References Cited

OTHER PUBLICATIONS

Evaluation of Mechanical Stability of a Commercial Sn88 Silicon Nitride at Intermediate Temperatures Hua-Tay Lin et al., J. Am. Ceram. Soc. Journal, 86 [7] 1176-81 (2003).
Research and Development of Ceramic Turbine Wheels, Keiichiro Watanabe et al., 36 I vol. 115, Jan. 1993, Transactions of the ASME; 92-GT-295.
Andre L. Neuburger et al., Design and Test of Non-rotating Ceramic Gas Turbine Components, ASME Turbo Expo 1988, ASME paper 88-GT-146.
Venkat Vedula et al.; Sector Rig Test of a Ceramic Matrix Composite (CMC) Combustor Liner, GT2006-90341, Proceedings of GT2006, ASME turbo Expo 2006: Power for Land, Sea and Air, Barcelona, Spain, May 8-11, 2006.
Venkat Vedula et al., Ceramic Matrix Composite Turbine Vanes for Gas Turbine Engines, GT2005-68229, Proceedings of ASME Turbo Expo 2005: Power for Land, Sea, and Air, Reno, Nevada, Jun. 6-9, 2005.
Tania Bhatia; Enabling Technologies for Hot Section Components, Contract N00014-06-C-0585, Final Report, Jan. 30, 2009.
Michael Verrilli et al.; Ceramic Matrix Composite Vane Subelement Testing in a Gas Turbine Environment, Proceedings of ASME Turbo Expo 2004, Power for Land, Sea, and Air, Jun. 14-17, 2004, Vienna, ASME Paper GT2004-53970.
K. Watanabe, et al.; Development of CMC Vane for Gas Turbine Engine, Ceramic Engineering and Science Proceedings, vol. 24, Issue 4, 2003, pp. 599-604.
Anthony Calomino et al.; Ceramic Matrix Composite Vane Subelement Fabrication, Proceedings of ASME Turbo Expo 2004, Power for Land, Sea, and Air, Jun. 14-17, 2004, Vienna, ASME Paper GT2004-53974.
Bhatia, T., et al.; CMC Combustor Line Demonstration in a Small Helicopter Engine, ASME Turbo Expo 2010, Glasgow, UK, Jun. 14-18, 2010; ASME Paper GT2010-23810.

* cited by examiner

GAS TURBINE SHROUD ARRANGEMENT

BACKGROUND

The present disclosure is directed to a shroud attachment which may be used in a turbine section of a gas turbine engine.

Ceramic materials have been studied for application to components in the hot section of gas turbine engines to replace metallic materials that require substantial cooling in order to withstand the high temperature of combustion gases. Ceramics have been made into turbine blades and vanes and integrally bladed rotors. In these cases, particularly that of ceramic integrally bladed rotors, a large gap between the rotor blade tip and metal shrouds may result from the low thermal expansion of ceramics that made up the blades and the integrally bladed rotors. The low density and high stiffness of ceramics reduce the radial displacement of the blade tip and potentially exacerbate the issue further. The large gap or clearance at the bade tip can result in a high percentage of the core flow leaking through the tip and in so doing, not transferring energy from gas flow to turbine blades, which may cause engine performance penalties as useful energy is not harnessed. The performance penalty can be more severe for small gas turbine engines wherein the small engine dimension makes a small tip clearance large relative to the gas flow path.

Ceramic shrouds have been used to control the gap between rotor blade tip and inner surface of the shroud for ceramic turbines to minimize losses induced by large tip clearance. Due to its high stiffness, low thermal expansion and low thermal conductivity, a ceramic shroud experiences less thermal distortion than a metal shroud for a given set of thermal loading conditions. The high temperature capability of the ceramics also leads to reduced cooling air requirements, an additional benefit to engine performance.

One issue which needs to be dealt with in ceramic shroud design is attachment to the metallic engine structure due to the low ductility and low thermal expansion of ceramics as compared to metals. Elastic springs have been used to support ceramic shrouds. Their performance at elevated temperatures over long durations require monitoring due to metal creep.

Another approach for supporting a ceramic shroud is through the tab and slot approach, where the tabs on the ceramic shroud can slide in and out of slots on a metallic casing. Generally, there are three tab and slot pairs evenly distributed circumferentially to spread the support load and to position the shroud radially. In theory, this approach can minimize thermal constraints by letting the ceramic shroud and metal support grow freely from each other. However, due to manufacturing tolerance control, uneven thermal fields, and thermal deformation of the shroud and the casing, thermal stress at the tabs could be sufficiently high to cause local damage.

Another method to support the ceramic turbine shroud is to use axial tabs that engage partially through axial slots in the shroud. This shroud design is assembled inside a turbine support case, which is often difficult to have easy access and therefore prone to assembly error. Further, the shroud is loaded axially forward from the power turbine vane pack when the engine is in operation. The relative axial movement between the ceramic turbine assembly and the power turbine vane depends on the material thermal expansion and engine conditions and therefore difficult to predict accurately.

SUMMARY

In accordance with the instant disclosure, there is provided a system for supporting a shroud used in an engine, the system broadly comprising: a shroud positioned radially outboard of a rotor, the shroud having a plurality of circumferentially spaced slots; a forward support ring for supporting the shroud; the forward support ring having a plurality of spaced apart first tabs on a first side for functioning as anti-rotation devices; said forward support ring having a plurality of spaced apart second tabs on a second side; and said second tabs engaging said slots in said shroud and circumferentially supporting said shroud.

Further in accordance with the instant disclosure, there is provided a method for assembling the shroud support system outside the engine. The method broadly comprises positioning a shroud support ring having a plurality of first tabs on a first surface for preventing rotation of said shroud support ring and a plurality of second tabs on a second surface opposed to said first surface, providing a ceramic shroud having a plurality of through slots, and positioning said ceramic shroud over said shroud support ring so that said second tabs slide into said through slots.

Other details of the gas turbine shroud attachment described herein are set forth in the following detailed description and the accompanying drawings wherein like reference numerals depict like elements.

DETAILED DESCRIPTION

Figure 1:
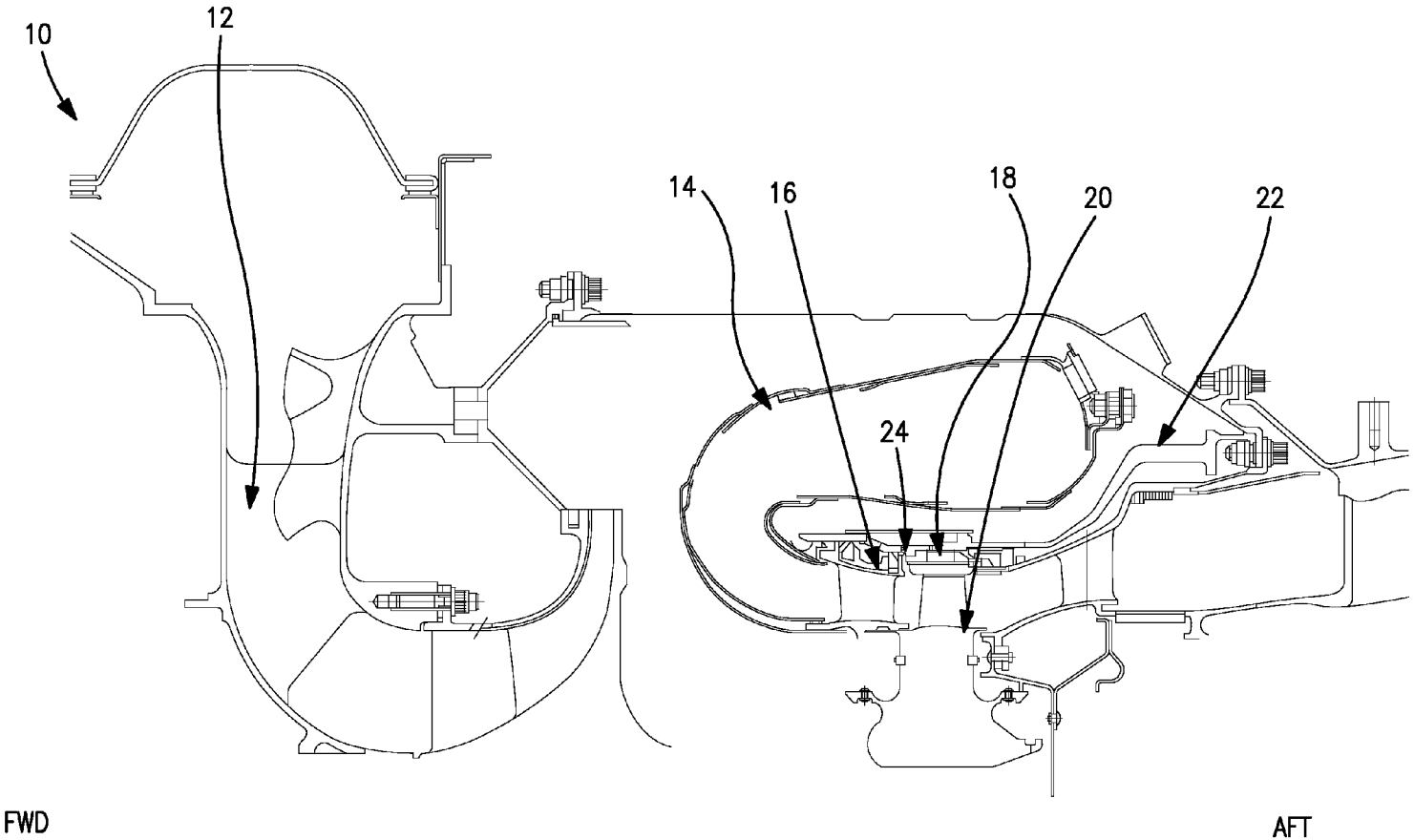
FIG. 1 shows a cross section of a gas turbine engine.
Figure 2:
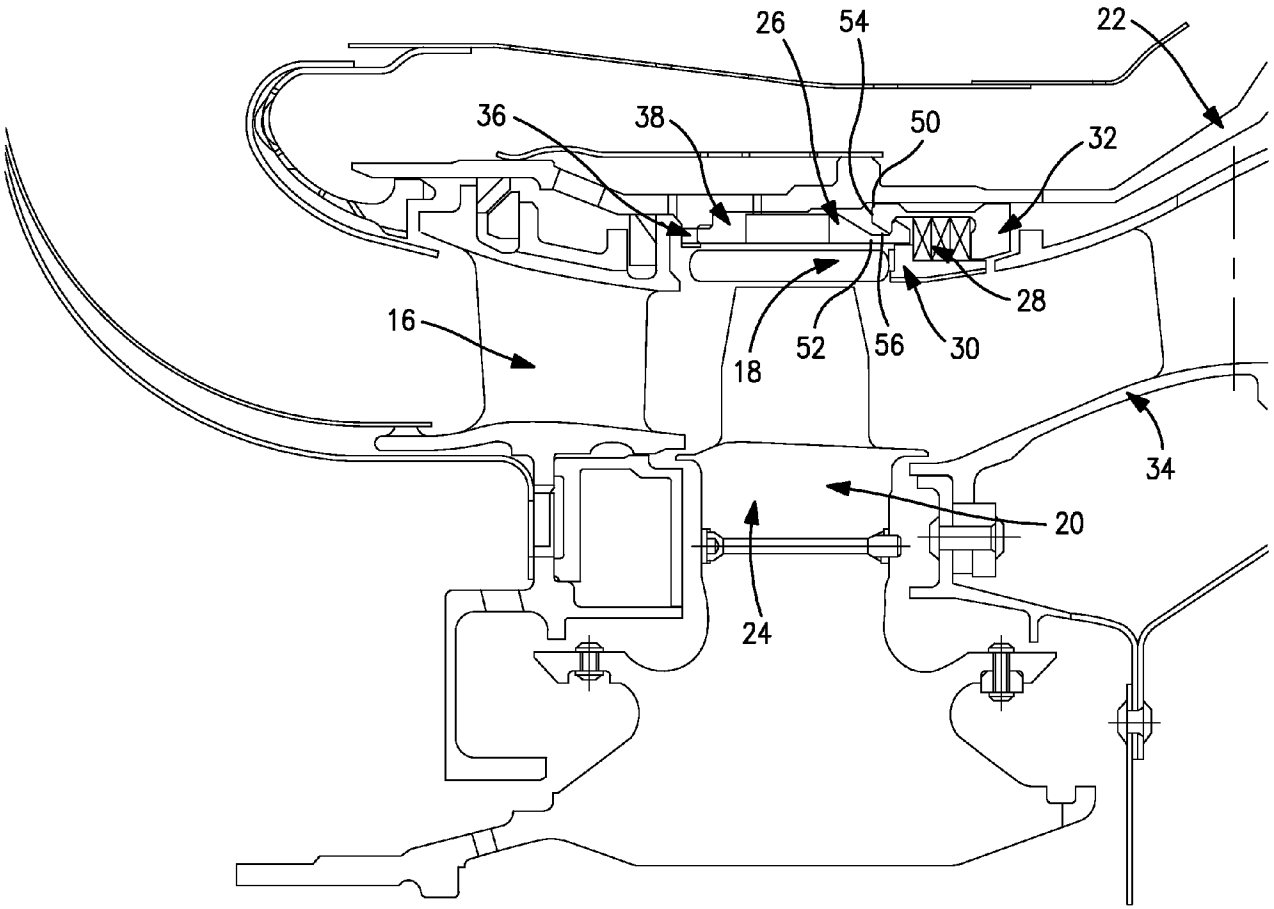
FIG. 2 shows the turbine section with a ceramic shroud.

There is shown in FIG. 1, a cross section of an engine 10. The engine includes a compressor 12 through which a fluid flows and is compressed, a combustor 14 in which the compressed fluid is mixed and burned with a fuel, and a turbine section 24 in which the heated fluid is expanded to drive the turbine for creating power to drive the compressor 12 and other systems. As can be seen in FIGS. 1 and 2, the turbine section 24 includes a turbine vane 16, a turbine shroud 18, a turbine rotor 20, and a turbine support case 22.

Referring now to FIG. 2, there is shown an enlarged view of the turbine section 24. As shown in this figure, there is the turbine vane 16 and the turbine rotor 20. Surrounding the rotor 20 is the shroud 18 which is formed from a ceramic material. The turbine section also includes a shroud support ring 26, a wave spring 28, a wave spring support ring 30, an aft ring 32 and a vane case 34.

Figure 3:
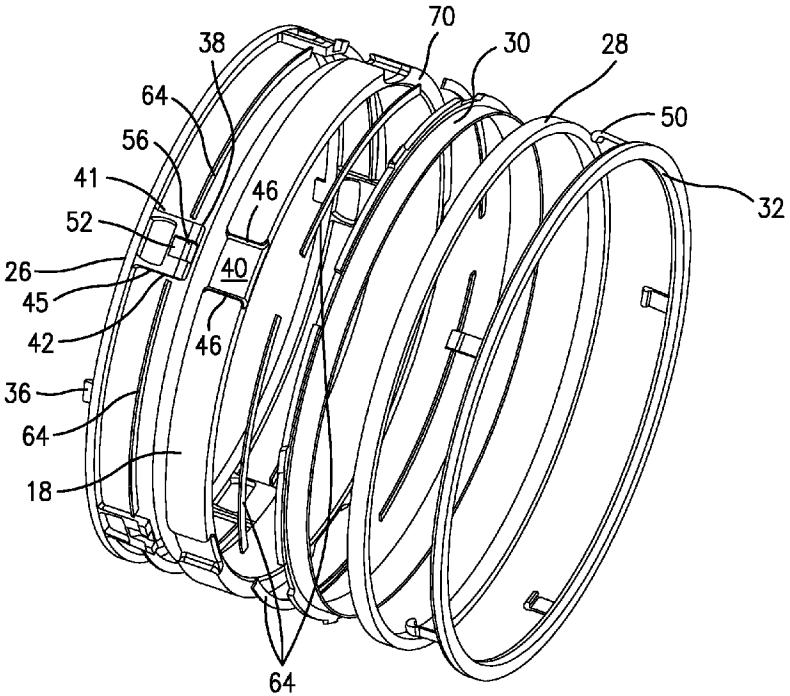
FIG. 3 is an isometric view of the ceramic shroud assembly.
Figure 4:
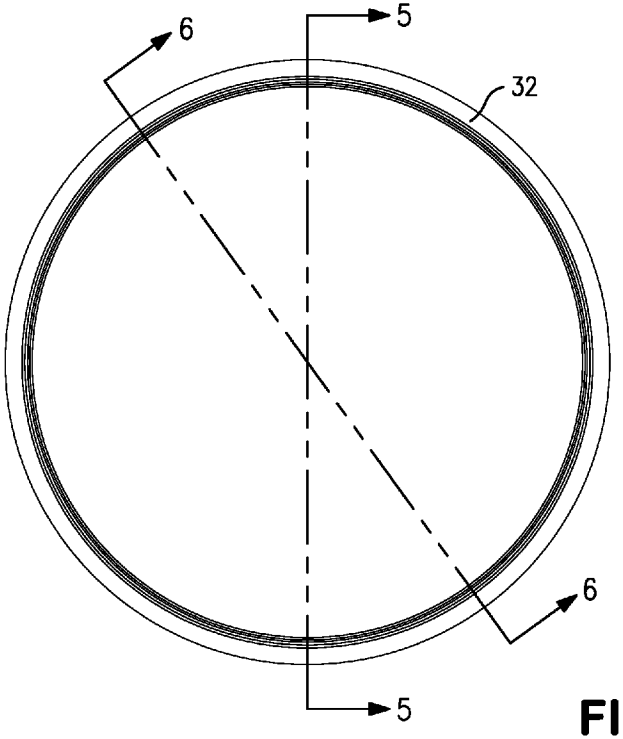
FIG. 4 is a rear end view of the ceramic shroud assembly of FIG. 3
Figure 5:
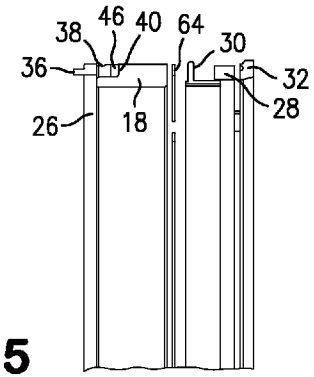
FIG. 5 is a sectional view of the ceramic shroud assembly taken along lines 5-5 in FIG. 4.
Figure 6:
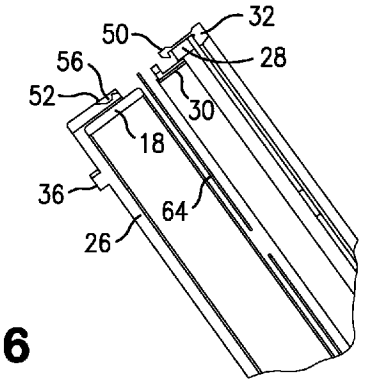
FIG. 6 is a sectional view of the ceramic shroud assembly taken along lines 6-6 in FIG. 4.
Figure 7:
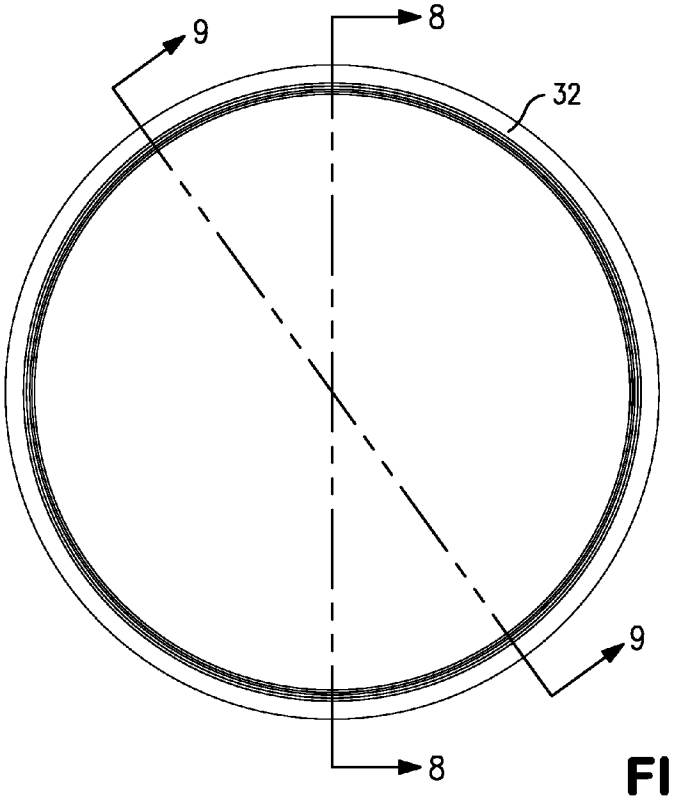
FIG. 7 is a rear view of the ceramic shroud assembly of FIG. 4 when assembled.
Figure 8:
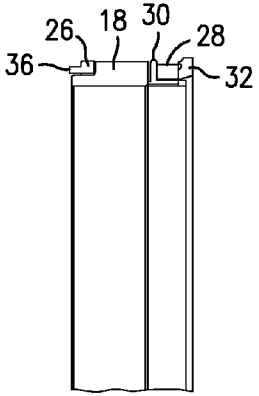
FIG. 8 is a sectional view taken along lines 8-8 in FIG. 7.

The ceramic shroud 18 is positioned radially outboard of the turbine rotor 20 and downstream of the turbine vane 16. Referring now to FIG. 3, the ceramic shroud 18 is supported by the shroud support ring 26 and loaded axially by the spring backing ring 30, which in turn is loaded by the aft ring 32. The shroud support ring 26 may be piloted on the inner diameter (ID) of the turbine support case 22. It has a plurality of front tabs 36 and a plurality of aft tabs 38. The front tabs 36 are located on a first side of the shroud support ring 26 and serve as anti-rotation devices. While two tabs 36 may be used, the actual number of tabs 36 can be either increased or decreased depending on the tangential loading on the ceramic shroud 18.

Referring now to FIGS. 3-9, the aft tabs 38 are located on a second side of the shroud support ring 26, which second side is opposed to said first side. The aft tabs 38 support the ceramic shroud 18 circumferentially. With a plurality of close tolerance slots and tabs contacted circumferentially, the shrouds position relative to the engine centerline is controlled and maintained. The aft tabs 38 are sized to act as stiff springs. The aft tabs 38 contact through slots 40 on the ceramic shroud 18 only on two sides in the hoop direction. The through slots 40 are formed as cut-out having side walls 46. The contact surface 42 of each aft tab 38 may be crowned to minimize stress concentration in the ceramic shroud 18 from any misalignment or tolerance issues. The slots 40 are through-slots to ease the machining and grinding step.

To prevent stress concentration, soft metal foils 41, such as platinum foils, can be inserted between the sides 45 of the aft tabs 38 and the side walls 46 of the slots 40 on the ceramic shroud 18. In lieu of the metal foils, a soft metal coating, such as a gold plating, can be applied to the sides 45 of the tabs 38.

The aft tabs 38 may be formed to bend so as to take out any machining, build out-of-tolerances, and distortion from thermal loading, without overstressing the ceramic shroud 18. The ceramic shroud 18 is thus free to grow radially relative to the aft tabs 38, thereby avoiding thermal stress build-up. The number of aft tabs 38 may be between three and eighteen. The higher the number of aft tabs 38, the tighter dimensional tolerance control needs to be and the more uniform the loading between the aft tabs 38 and the ceramic shroud 18.

The aft tabs 38 may be formed from a metallic material and may be hollowed to reduce their local contact stiffness with the ceramic shroud 18 and global bending stiffness relative to their roots. The cut-out size and wall thickness are determined to minimize local contact induced stress and to provide sufficient stiffness in the circumferential direction to maintain shroud concentricity with the turbine.

Figure 9:
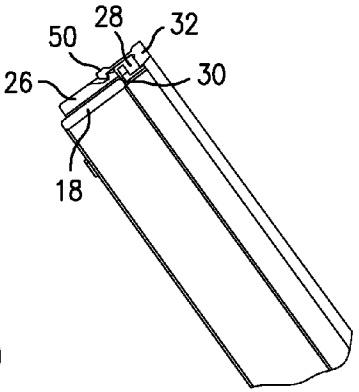
FIG. 9 is a sectional view taken along lines 9-9 in FIG. 7.

As shown in FIGS. 3 and 9, aft tabs 38 on the front support ring 26 engage with tabs 50 on the aft ring 32 through a hook-clip arrangement. The tapered tip of the tabs 50 on the aft ring 32 slides over a sloped surface 52 on the tabs 38 of the forward ring 26 and into a recessed pocket 56 in the tabs 38 where they engage a mating surface 53. The shroud support ring 26 and the aft ring 32 are locked together once the tabs 50 are clicked in place with the aft tabs 38.

Referring now to FIG. 9, the rings 26, 30, and 32 are locked in such a way that a predetermined compression of the wave spring 28 is introduced and therefore there is a controlled preload on the ceramic shroud 18. The wave spring 28 may be preloaded to a desired load level and the load may increase or decrease depending on the relative thermal growth of the ceramic shroud 18 and the front and aft support rings 26 and 32 respectively. Since the ceramic shroud 18 is approximately three times hotter than the rings 26 and 32, which may both be formed from metal, while its thermal expansion coefficient is approximately one third of that of the rings 26 and 32, the thermal growth mismatch between the ceramic shroud 18 and the metal rings 26 and 32 is small. As a result of this, a nearly constant clamp load may be maintained throughout all engine operating conditions.

Various radial and axial gaps are carefully designed to avoid interference and loss of assembly from thermal growth mismatch. The radial gap between the ID of the front tabs 36 on the front metal support ring 26 and the outer diameter (OD) of the ceramic shroud 18 is set so that a positive gap is always maintained during engine transients. Further, this radial gap is large enough that during assembly the front tabs 36 do not bend and contact the OD of the ceramic shroud 18.

A radial gap may be designed between the ID of the turbine support case 22 and the OD of the tabs 50 on the aft ring 32. This gap should be big enough to allow easy assembly, but may be small relative to the radial overlap between the front tab 36 and the aft tab 38. Such a gap design ensures that the aft tabs 38 do not unclip during all engine operating conditions.

Soft rings 64, such as segmented or unsegmented gaskets, can be placed at two ceramic metal interfaces: (1) between the forward shroud support ring 26 and the front vertical face of the ceramic shroud 18; and (2) between the aft vertical face 70 of the ceramic shroud 18 and the rear or aft ring 32. The rings 64 may be formed from any suitable material such as mica.

The inner diameter of the wave spring support ring 30 may have a thermal barrier coating if desired.

Figure 10:
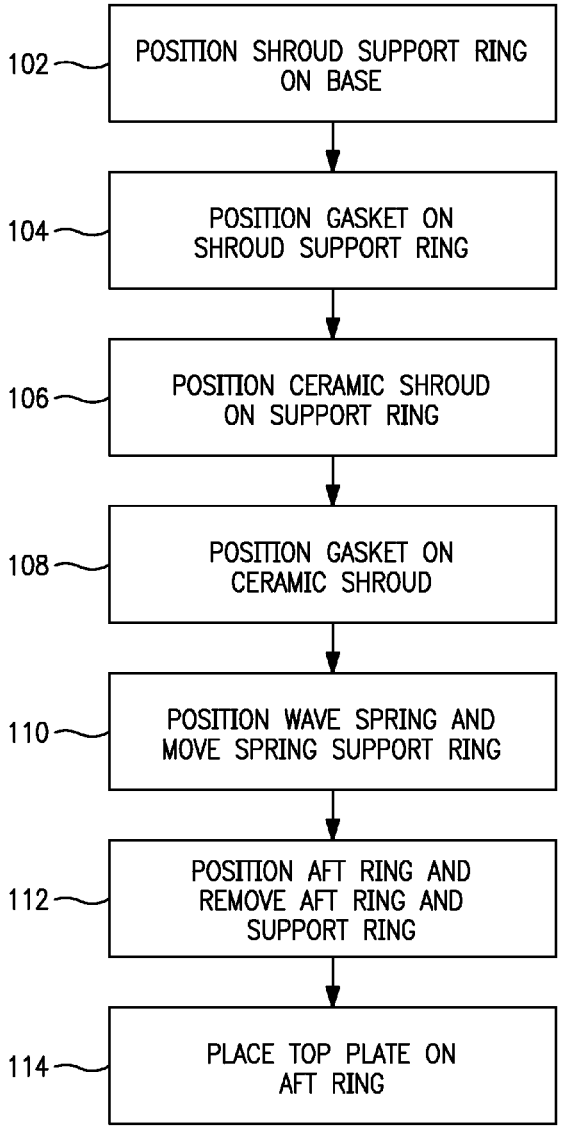
FIG. 10 is a flow chart showing the steps of the method for assembling the gas turbine shroud attachment assembly.

The gas turbine shroud attachment system described herein may be assembled outside the engine. Referring now to FIG. 10, the steps of assembling the attachment system is as follows. In step 102, the shroud support ring 26 is positioned on a base plate. In step 104, one of the gaskets 64 is positioned on a rear facing wall of the shroud ring 26. In step 106, the ceramic shroud 18 is positioned on the shroud support ring 26 so that the aft tabs 38 slide into contact with the slots. In step 108, a second gasket 64 may be positioned on a rearward face of the shroud 18. The second gasket 64 may be glued or otherwise bonded to the rearward face of the shroud. In step 110, the wave spring support ring 30 is positioned adjacent the second gasket 64 and the wave spring 28 is positioned on the support ring 30. In step 112, the aft ring 32 is positioned against the wave spring 28. Thereafter, the wave spring 28 and the aft ring 32 are positioned so that the wave spring 28 contacts and is supported by the wave spring support ring 30 and the tabs 50 on the aft ring 32 mate with the tabs 38 on the support ring 26. In step 114, an assembly top plate is placed over the aft ring 32. Screw down bolts may be used to draw the ring 30 down onto the support ring 26. The base and top plates may then be removed if desired and the assembled shroud attachment assembly may be installed in the gas turbine engine.

Figure 11:
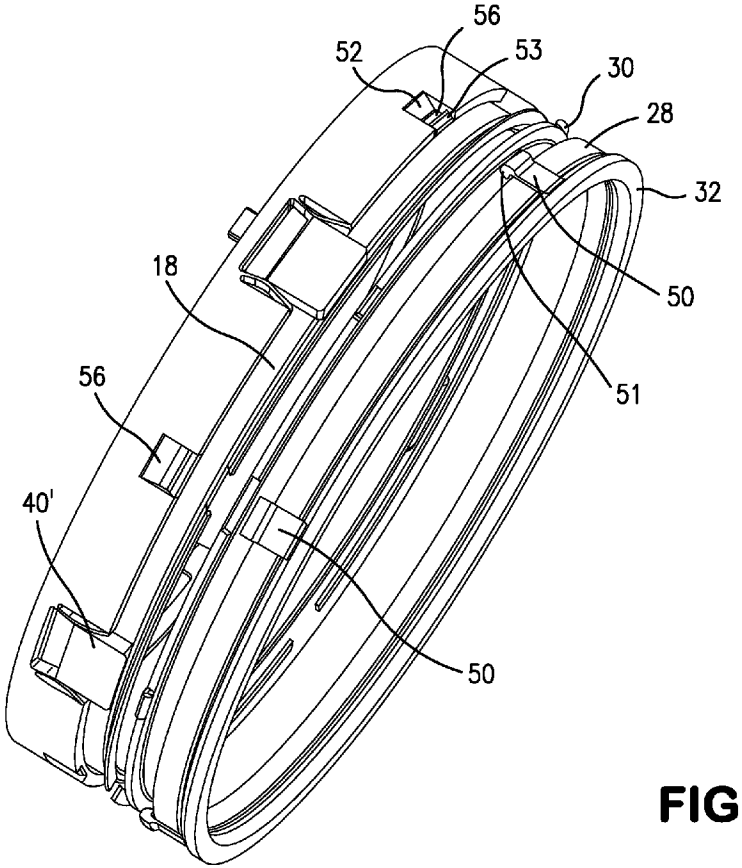
FIG. 11 illustrates an alternative ceramic shroud assembly.
Figure 12:
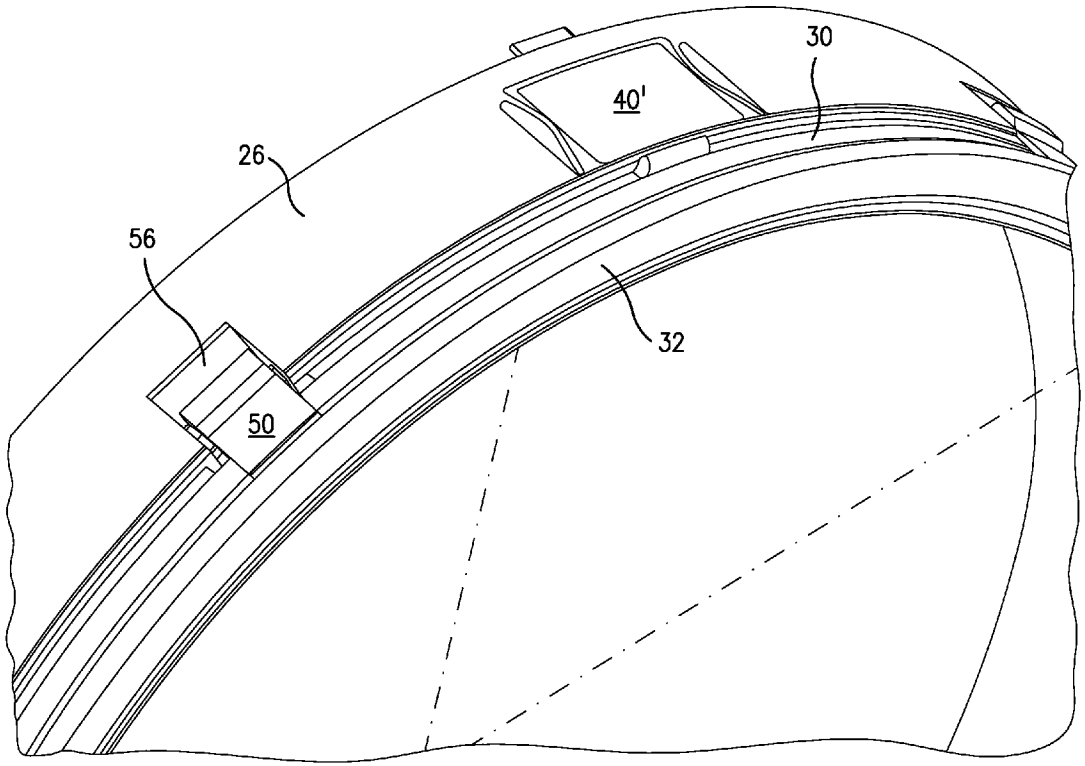
FIG. 12 illustrates the assembly of FIG. 12 in an assembled position.

Referring now to FIGS. 11 and 12, there is shown an alternative shroud attachment assembly. As before, the assembly has shroud support ring 26, a ceramic shroud 18, a wave spring support ring 30, a wave spring 28, and an aft ring 32. The ceramic shroud 18 in this alternative assembly is different from the ceramic shroud 18 in FIG. 3 in that the slot 40 has an arc length that creates a protrusion 40' where the sides 46 are parallel. As can be seen from FIGS. 12 and 13, the shroud support ring 26 has aft tabs 38 that have a very large arc length as compared to the narrow tabs in FIG. 3. The recessed pocket 56 centered in tab 38 mates with clips 50 on the aft ring 32. The aft tabs 38 fit into the slots 40 in the ceramic shroud 18. Each of the recessed pockets 56 has an angled surface 52. Each of the tabs 50 has a hook portion 51 which mates with a mating surface 53 in the pocket 56.

Figure 13:
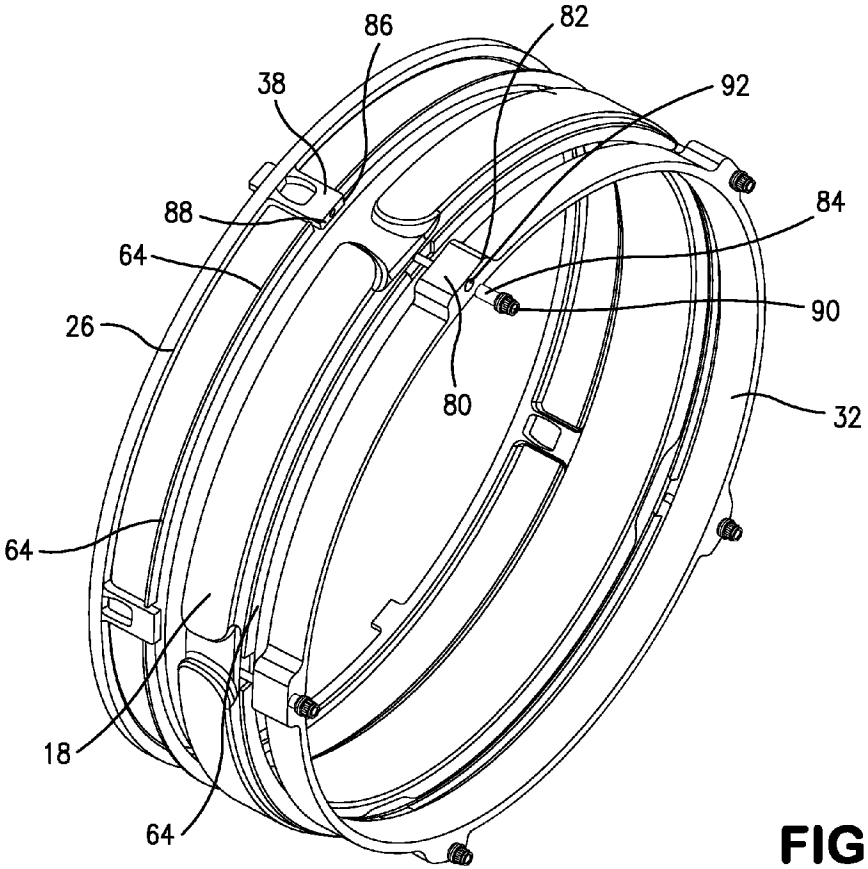
FIG. 13 illustrates another alternative ceramic shroud assembly.
Figure 14:
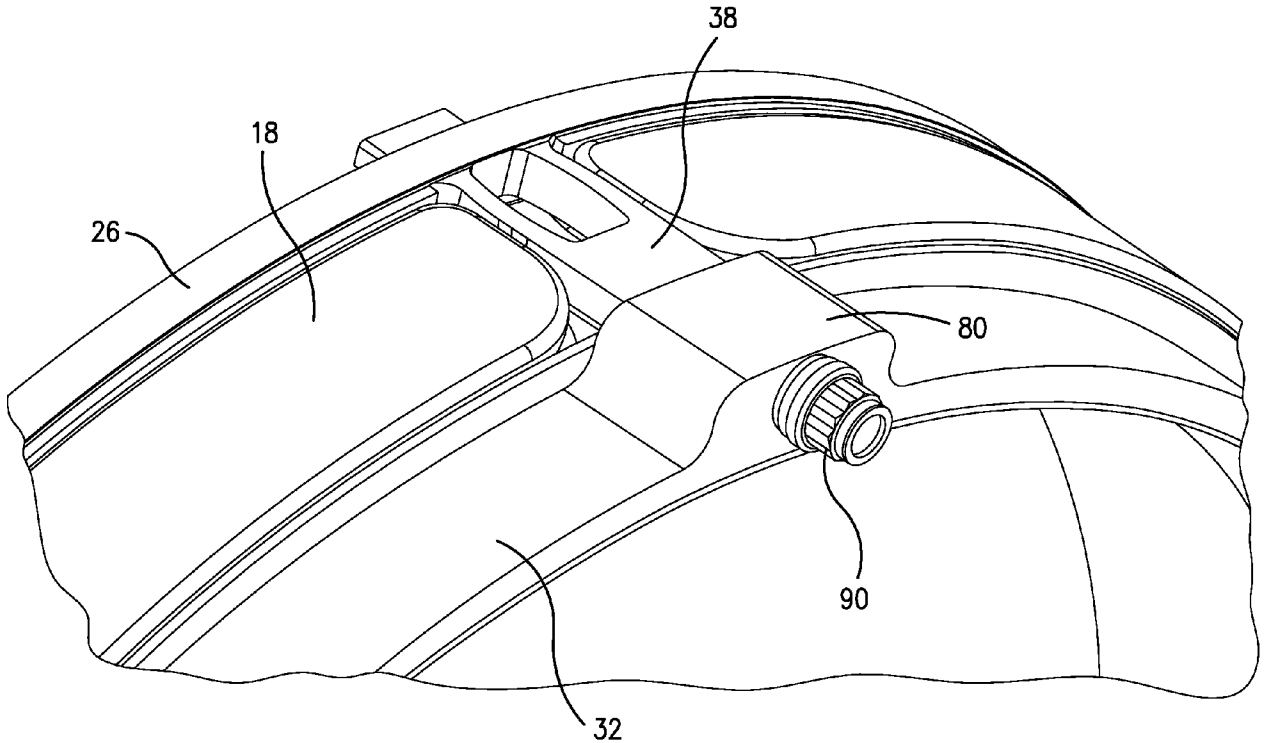
FIG. 14 illustrates the assembly of FIG. 14 in an assembled position.

Referring now to FIGS. 13 and 14, there is shown yet another alternative shroud attachment assembly. As before, the assembly includes a shroud support ring 26, a ceramic shroud 18, a segmented gasket 64 between the support ring 26 and the ceramic shroud 18, a gasket ring 64 positioned on a rear end face of said ceramic shroud 18, and an aft ring 32'. In this assembly, the aft ring 32' no longer has the tabs 50. Instead, the aft ring 32' has a plurality of raised portions 80 having a through hole 82 for receiving a threaded stud 84. The aft tab 38, instead of having an angled surface 52 and a recessed pocket 56, has a threaded opening 86 in an end tip portion 88. The threaded opening 86 receives an end portion of the threaded stud 84 to secure the aft ring 32 to the aft tab 38. A locking nut 90 is provided to secure the aft ring 32 in position with respect to the support ring 26 and the ceramic shroud 18. The locking nut 90 engages an end portion of the stud 84. If desired a spring washer 92 may be provided between an end surface of each raised portion 80 and the locking nut 90.

There has been described herein a gas turbine shroud attachment. While the gas turbine shroud attachment has been described in the context of a specific embodiment thereof, other unforeseen variations, alternatives, and modifications may become apparent to those skilled in the art having read the foregoing description. Accordingly, it is intended to embrace those alternatives, variations, and modifications which fall within the broad scope of the appended claims.

What is claimed is:

1. A system for supporting a shroud used in an engine, said system comprising:

a shroud positioned radially outboard of a rotor, said shroud having a plurality of circumferentially spaced slots;

a forward support ring for supporting said shroud;

said forward support ring having a plurality of spaced apart first tabs on a first side for functioning as anti-rotation devices;

said forward support ring having a plurality of spaced apart second tabs on a second side;

said second tabs engaging said slots in said shroud and circumferentially supporting said shroud; and an aft ring, said aft ring having a plurality of clip tabs, and said clip tabs engaging said second tabs.

2. The system of claim 1, wherein said shroud is a ceramic shroud and said rotor is a turbine rotor.

3. The system of claim 1, further comprising a vane and said shroud being positioned downstream of said vane.

4. The system of claim 1, further comprising a spring support ring for axially loading said forward shroud ring.

5. The system of claim 4, further comprising a clip ring for loading said spring support ring.

6. The system of claim 1, further comprising said slots in said shroud being formed by a plurality of cut-outs and each of said cut-outs having side walls.

7. A system for supporting a shroud used in an engine, said system comprising:

a shroud positioned radially outboard of a rotor, said shroud having a plurality of circumferentially spaced slots;

a forward support ring for supporting said shroud;

said forward support ring having a plurality of spaced apart first tabs on a first side for functioning as anti-rotation devices;

said forward support ring having a plurality of spaced apart second tabs on a second side;

said second tabs engaging said slots in said shroud and circumferentially supporting said shroud;

said slots in said shroud being formed by a plurality of cut-outs and each of said cut-outs having side walls; and a metallic material positioned between sides of the second tabs and said side walls of said cut-outs.

8. The system of claim 7, wherein said metallic material comprises a metal foil.

9. The system of claim 8, wherein said metal foil comprises a platinum foil.

10. The system of claim 7, wherein said metallic material is a metal plating.

11. The system of claim 10, wherein said metal plating is a gold plating.

12. The system of claim 1, wherein said support ring has from three to eight second tabs and said second tabs are circumferentially spaced around said support ring.

13. A system for supporting a shroud used in an engine, said system comprising:

a shroud positioned radially outboard of a rotor, said shroud having a plurality of circumferentially spaced slots;

a forward support ring for supporting said shroud;

said forward support ring having a plurality of spaced apart first tabs on a first side for functioning as anti-rotation devices;

said forward support ring having a plurality of spaced apart second tabs on a second side; and said second tabs engaging said slots in said shroud and circumferentially supporting said shroud, wherein at least one of said second tabs is hollowed to reduce local contact stiffness with said shroud.

14. The system of claim 1, wherein said clip tabs are hook-shaped and engage sloped surfaces of said additional tabs.

15. The system of claim 1, further comprising a wave spring and said engagement between said support ring and said aft ring compressing said wave spring and thereby pre-loading said shroud.

16. A system for supporting a shroud used in an engine, said system comprising:

a shroud positioned radially outboard of a rotor, said shroud having a plurality of circumferentially spaced slots;

a forward support ring for supporting said shroud;

said forward support ring having a plurality of spaced apart first tabs on a first side for functioning as anti-rotation devices;

said forward support ring having a plurality of spaced apart second tabs on a second side;

said second tabs engaging said slots in said shroud and circumferentially supporting said shroud; and said support ring having a plurality of additional tabs, said additional tabs being offset from said second tabs, an aft ring, said aft ring having a plurality of clip tabs, and said clip tabs engaging said additional tabs.

17. A system for supporting a shroud used in an engine, said system comprising:

a shroud positioned radially outboard of a rotor, said shroud having a plurality of circumferentially spaced slots;

a forward support ring for supporting said shroud;

said forward support ring having a plurality of spaced apart first tabs on a first side for functioning as anti-rotation devices;

said forward support ring having a plurality of spaced apart second tabs on a second side;

said second tabs engaging said slots in said shroud and circumferentially supporting said shroud; and each of said second tabs having an end portion with an opening, an aft ring, a plurality of raised portions circumferentially spaced around a periphery of said aft ring and being aligned with said second tabs, each of said raised portions having a through hole, and a plurality of studs, each of said studs passing through said through hole in one of said raised portions and engaging one of said openings in said end portion of one of said second tabs.

18. The system of claim 17, further comprising a plurality of locking nuts, and each of said locking nuts engaging an end of one of said studs.

19. A method for assembling an assembly for supporting a shroud in a turbine section of an engine comprising the steps of:

positioning a shroud support ring having a plurality of first tabs on a first surface for preventing rotation of said shroud support ring and a plurality of second tabs on a second surface opposed to said first surface;

providing a ceramic shroud having a plurality of through slots;

positioning said ceramic shroud over said shroud support ring so that said second tabs slide into said through slots;

placing an aft ring adjacent said wave spring and said wave spring support ring; and securing said aft ring to each of said second tabs.

20. The method of claim 19, further comprising placing a segmented gasket between said shroud support ring and said ceramic shroud.

21. The method of claim 19, further comprising:

providing a wave spring support ring and a wave spring;

positioning said wave spring on said wave spring support ring; and moving said wave spring and said wave spring support ring in proximity to said ceramic shroud.

22. The method of claim 21, further comprising positioning a gasket ring between said wave spring and said ceramic shroud.

23. The method of claim 19, further comprising:

providing each of said second tabs with an angled portion and a recessed pocket;

providing said aft ring with a plurality of clips having a hook portion; and said securing step comprising engaging said hook portions of said clips with said recessed pockets in said second tabs.

24. The method of claim 19, further comprising:

providing an opening in an end tip of each of said second tabs;

providing said aft ring with a plurality of raised portions each having a through hole; and said securing step comprising passing a plurality of studs into said through holes so as to engage said openings in said second tabs and placing a locking nut on an end of each of said studs.

25. The method of claim 19, wherein said assembling of said assembly is performed outside of the engine and said assembly is inserted into said engine.

* * * * *